US010098441B1

(12) United States Patent
Holloman et al.

(10) Patent No.: US 10,098,441 B1
(45) Date of Patent: Oct. 16, 2018

(54) PROTECTIVE BACK-PACK

(71) Applicant: Ballistipax LLC, Melbourne, FL (US)

(72) Inventors: Jason Holloman, Cocoa, FL (US); David Malis, Melbourne, FL (US)

(73) Assignee: Ballistipax, LLC, Melbourne, FL (US)

( * ) Notice: Subject to any disclaimer, the term of this patent is extended or adjusted under 35 U.S.C. 154(b) by 0 days.

(21) Appl. No.: 15/946,876

(22) Filed: Apr. 6, 2018

(51) Int. Cl.

| | |
|---|---|
| ***A45F 4/02*** | (2006.01) |
| ***A45F 3/04*** | (2006.01) |
| ***F41H 1/02*** | (2006.01) |
| *A45F 3/06* | (2006.01) |
| *A45F 3/00* | (2006.01) |

(52) U.S. Cl.
CPC ..... *A45F 3/047* (2013.01); *F41H 1/02* (2013.01); *A45F 3/042* (2013.01); *A45F 3/06* (2013.01); *A45F 2003/001* (2013.01)

(58) Field of Classification Search
CPC ... A45F 2004/006; A45F 2004/02; A45F 4/02
USPC ..... 224/153, 577, 628, 632
See application file for complete search history.

(56) References Cited

U.S. PATENT DOCUMENTS

| | | | | |
|---|---|---|---|---|
| 4,507,802 | A | 4/1985 | Small | |
| 4,830,245 | A | 5/1989 | Arakaki | |
| 5,060,314 | A * | 10/1991 | Lewis | A62B 17/003 2/2.5 |
| 5,644,792 | A | 7/1997 | Tishler et al. | |
| 5,829,653 | A | 11/1998 | Kaiser | |
| 6,161,738 | A | 12/2000 | Norris | |
| 6,419,132 | B1 | 7/2002 | Reed et al. | |
| 6,685,071 | B2 | 2/2004 | Prather | |
| 7,424,748 | B1 * | 9/2008 | McDunn | F41H 5/013 2/102 |
| 7,441,278 | B2 | 10/2008 | Blakeley | |
| 7,971,516 | B2 | 7/2011 | Hogan | |
| 8,181,834 | B1 | 5/2012 | Howell | |
| 8,844,062 | B2 | 9/2014 | Tirard | |
| 8,997,262 | B2 | 4/2015 | Klein | |
| 9,003,947 | B1 * | 4/2015 | Rittenhouse, Jr. | F41H 1/02 2/2.5 |
| 9,027,810 | B1 | 5/2015 | Piersol | |
| 9,044,074 | B1 * | 6/2015 | De Freitas | F41H 5/013 |
| 9,200,871 | B2 | 12/2015 | Hexels | |
| 9,354,023 | B1 * | 5/2016 | Rittenhouse, Jr. | F41H 1/02 |
| 2007/0295772 | A1 | 12/2007 | Woodmansee | |
| 2009/0014490 | A1 | 1/2009 | Bradley | |

(Continued)

*Primary Examiner* — Brian D Nash
(74) *Attorney, Agent, or Firm* — Kelly G. Swartz; Widerman Malek, PL

(57) ABSTRACT

A personal protection device including a front body armor carrier and a pack. The front body armor carrier includes a torso portion, two shoulder portions, and a handle. The torso portion has an upper portion, an opposing lower portion, a first side extending from the upper portion to the lower portion, and a second side opposing the first side and extending from the upper portion to the lower portion. The first shoulder portion extends away from the upper portion proximate the first side while the second shoulder portion extends away from the upper portion proximate the second side. The handle has two ends, each secured to the lower portion forming an opening between the handle and the lower portion. The pack is removably secured to the front body armor carrier and adapted to carry the front body armor carrier in a non-deployed configuration.

19 Claims, 10 Drawing Sheets

(56) References Cited

U.S. PATENT DOCUMENTS

| | | | | |
|---|---|---|---|---|
| 2009/0117300 | A1 | 5/2009 | Thompson | |
| 2009/0206115 | A1* | 8/2009 | Gleason | A45F 3/04 224/153 |
| 2010/0294820 | A1 | 11/2010 | Neibarger | |
| 2011/0113520 | A1* | 5/2011 | Dennis | F41H 1/02 2/2.5 |
| 2011/0278338 | A1 | 11/2011 | Darnell et al. | |
| 2015/0048133 | A1 | 2/2015 | Alba et al. | |
| 2015/0082524 | A1 | 3/2015 | Ben David | |
| 2015/0338193 | A1 | 11/2015 | Walker et al. | |
| 2017/0013948 | A1* | 1/2017 | Duthoit | A45F 3/06 |

* cited by examiner

PROTECTIVE BACK-PACK

FIELD OF THE INVENTION

The present invention relates to systems and methods for protective backpacks. More specifically, the present invention is directed to a system for providing an envelope for carrying front body armor, which is stored in a back pack and easily deployable in the event of an active shooter situation, and rear body armor.

BACKGROUND

The world has become a place where people are no longer safe at public gatherings and our children are no longer safe at their schools. It is now not a question of whether gun violence but a presumption that that it will and a question of what is to be done about it. Law enforcement officers are often the first to respond to active shooter situations and are expected to quickly confront an attacker.

Given that many law enforcement officers may carry their gear in backpacks and lay people use backpacks to transport their personal effects to and from school, work, the gym, and other recreational venues, there is a need for an improved backpack for carrying personal items while also having the ability to carry ballistic armor that is quickly movable between stored and deployed configuration for providing ballistic protection for the majority of the upper torso including the belly, chest, and back in the event of an active shooter.

Existing backpacks with deployable armor are not easy to deploy and may easily jam in an emergency situation. For example U.S. Pat. No. 6,419,132 discloses body armor that must be grasped by the user using both hands and pulled over the user's head. The mechanism for carrying the body armor requires that even pressure be applied to both sides of the armor at the time of deployment or the body armor may become jammed in the carrying device.

Therefore, there exists a need for a protective backpack, which provides ballistic protection, is versatile, has an innocuous appearance, and may be easily deployed by a user.

This background information is provided to reveal information believed by the applicant to be of possible relevance to the present invention. No admission is necessarily intended, nor should be construed, that any of the preceding information constitutes prior art against the present invention.

SUMMARY OF THE INVENTION

With the above in mind, embodiments of the present invention are related to a personal protection device including a front body armor carrier and a pack. The front body armor carrier may include a torso portion, first and second shoulder portions, and a handle. The torso portion may have an upper portion, an opposing lower portion, a first side extending from the upper portion to the lower portion, and a second side opposing the first side and extending from the upper portion to the lower portion. The first shoulder portion may extend away from the upper portion proximate the first side and the second shoulder portion may extend away from the upper portion proximate the second side. The handle may have a first end secured to the lower portion and a second end secured to the lower portion, thereby forming an opening between the handle and the lower portion. The pack may be removably secured to the front body armor carrier and adapted to carry the front body armor carrier in a non-deployed configuration.

The personal protection device may also include first and second armor carrier straps and first and second armor fasteners. The first and second armor carrier straps may each have a first end secured to a respective shoulder portion. The first and second armor carrier fasteners may each be secured to a second end of a respective armor carrier strap.

The pack may include first and second pack fasteners and first and second shoulder straps. Each of the first and second pack fasteners may be secured to the pack and adapted to mate with a respective armor carrier fastener. Each of the first and second shoulder straps may have a first end secured to the pack and a second end secured to the pack.

The personal protection device may also include first and second rotational buckles, each secured to the first end of a respective armor carrier strap and a respective shoulder portion. The front body armor carrier may include a front plate envelope located between a front portion of the front body armor carrier and a back portion of the front body armor carrier. The front plate envelope may be adapted to removably carry a plate.

The front body armor carrier may further include a first fastener and a lower retention flap. The first fastener may be disposed on a rear surface of a front portion of the front body armor carrier. The lower retention flap may be located at the lower portion of the front portion of the front body armor carrier proximate an opening of the front plate envelope. The lower retention flap may have a second fastener disposed thereon and be adapted to be positioned across the opening and securable to the first fastener.

The front body armor carrier may still further include a first fastener secured to a front surface of the front portion of the front body armor carrier. The personal protection device may include a panel having a first side with a panel fastener disposed thereon and an opposing second side with indicia disposed thereon. The panel fastener may be adapted to mate with the first fastener secured to the front surface of the front portion of the front body armor carrier.

The pack may further include front body armor carrier and rear body armor envelopes. The front body armor carrier envelope may be adapted to carry the front body armor carrier in a non-deployed configuration. The rear body armor envelope may be adapted to carry a rear plate. The rear body armor envelope may lie in a first plane parallel to a second plane of the front body armor carrier envelope.

The pack may further include first and second flaps. The first flap may be secured to an upper portion of a front side of the pack. The second flap may be secured to an upper portion of a back side of the pack and cooperatively configured with the first flap to extend across an entirety of a top side of the pack in a non-deployed configuration.

The pack may yet further include first and second magnets. The first magnet may be carried by the first flap. The second magnet may be carried by the second flap and adapted to attract the first magnet to maintain the first flap and the second flap in a closed configuration. The handle may be positioned proximate the first and second flap in the non-deployed configuration. The personal protection device may further include a utility pouch removably secured to a side of the pack.

DETAILED DESCRIPTION OF THE INVENTION

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Those of ordinary skill in the art realize that the following descriptions of the embodiments of the present invention are illustrative and are not intended to be limiting in any way. Other embodiments of the present invention will readily suggest themselves to such skilled persons having the benefit of this disclosure. Like numbers refer to like elements throughout.

Although the following detailed description contains many specifics for the purposes of illustration, anyone of ordinary skill in the art will appreciate that many variations and alterations to the following details are within the scope of the invention. Accordingly, the following embodiments of the invention are set forth without any loss of generality to, and without imposing limitations upon, the claimed invention.

In this detailed description of the present invention, a person skilled in the art should note that directional terms, such as "above," "below," "upper," "lower," and other like terms are used for the convenience of the reader in reference to the drawings. Also, a person skilled in the art should notice this description may contain other terminology to convey position, orientation, and direction without departing from the principles of the present invention.

Furthermore, in this detailed description, a person skilled in the art should note that quantitative qualifying terms such as "generally," "substantially," "mostly," and other terms are used, in general, to mean that the referred to object, characteristic, or quality constitutes a majority of the subject of the reference. The meaning of any of these terms is dependent upon the context within which it is used, and the meaning may be expressly modified.

Figure 10:
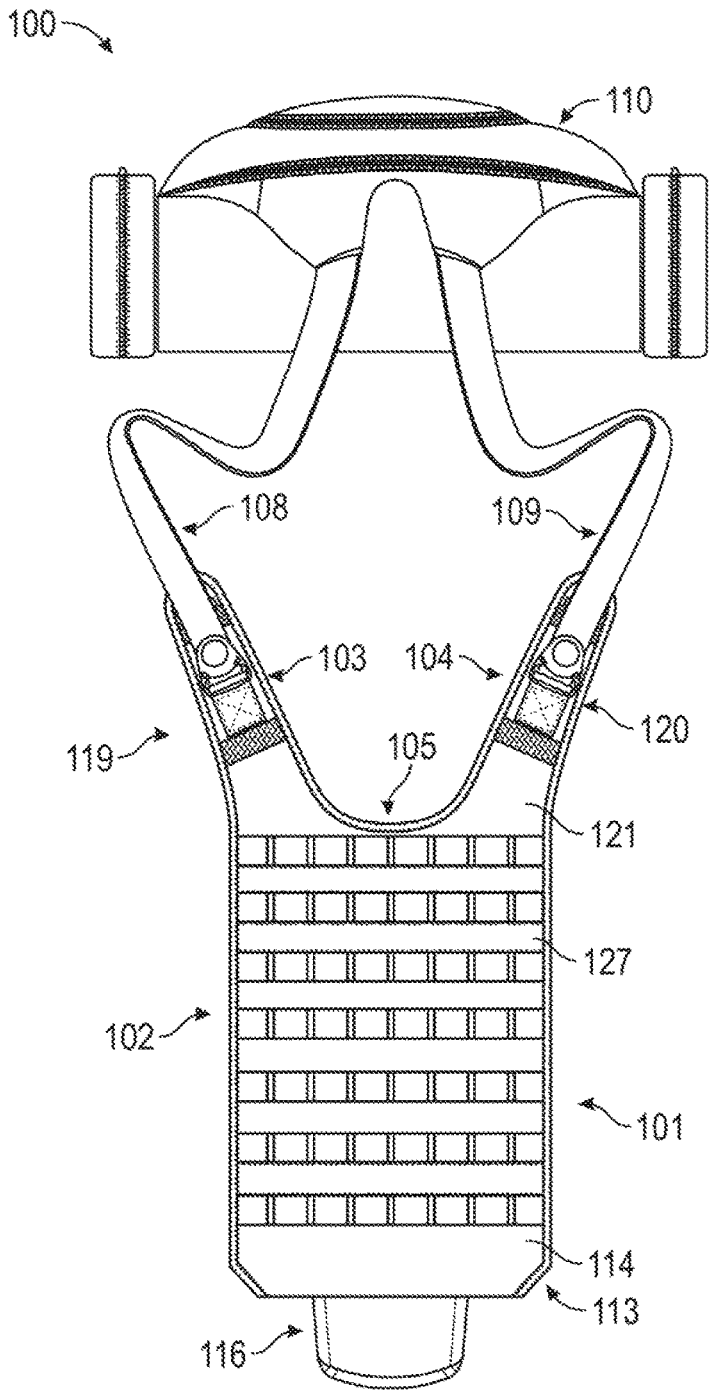
FIG. 10 is a perspective view of the personal protection device of FIG. 1 in a deployed position.
Figure 11:
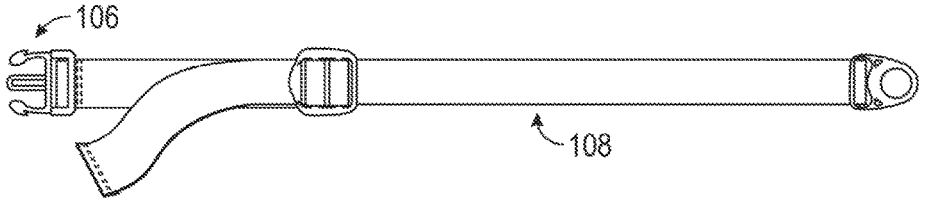
FIG. 11 is a top view of an armor carrier strap of the personal protection device of FIG. 1.
Figure 12:
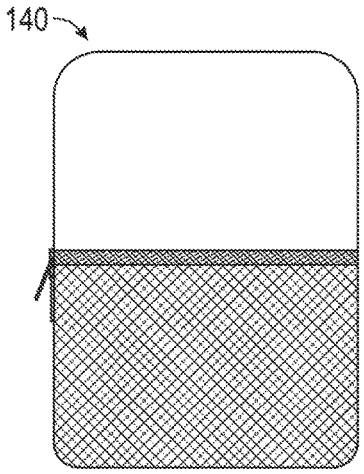
FIG. 12 is a front elevation view of a utility pouch of the personal protection device of FIG. 1.
Figure 13:
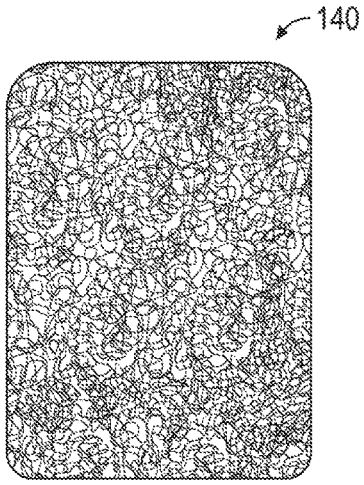
FIG. 13 is a rear elevation view of the utility pouch of FIG. 12.
Figure 14:
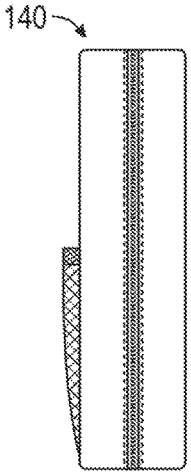
FIG. 14 is a first side view of the utility pouch of FIG. 12.
Figure 15:
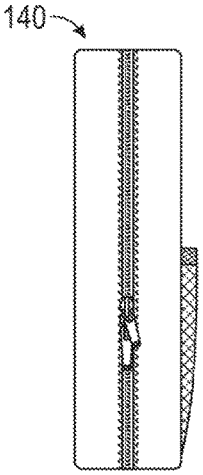
FIG. 15 is a second side view of the utility pouch of FIG. 12.
Figure 16:
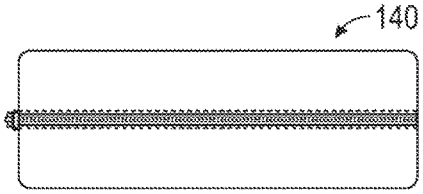
FIG. 16 is a top view of the utility pouch of FIG. 12.
Figure 17:
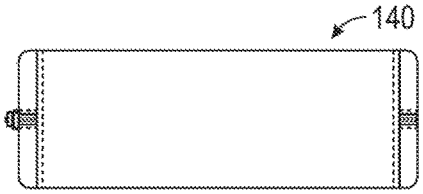
FIG. 17 is a bottom view of the utility pouch of FIG. 12.
Figure 21:
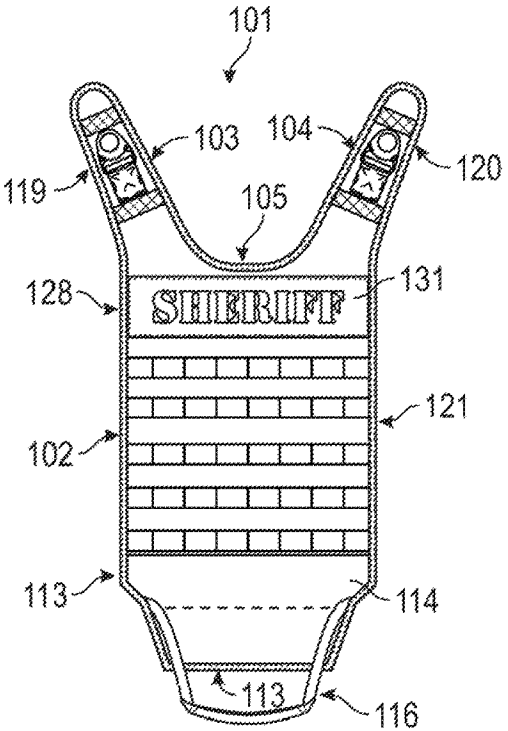
FIG. 21 is a front view of the front body armor carrier of FIG. 18 with the panel of FIG. 19 attached.
Figure 19:
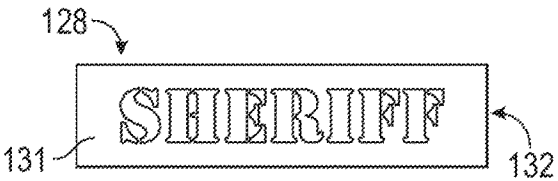
FIG. 19 is a front elevation view of a panel of the personal protection device of FIG. 1.
Figure 20:
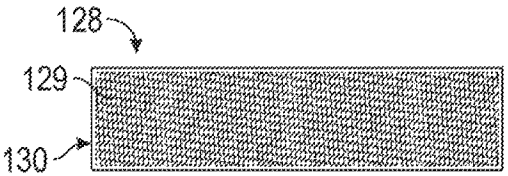
FIG. 20 is a rear elevation view of the panel of FIG. 19
Figure 18:
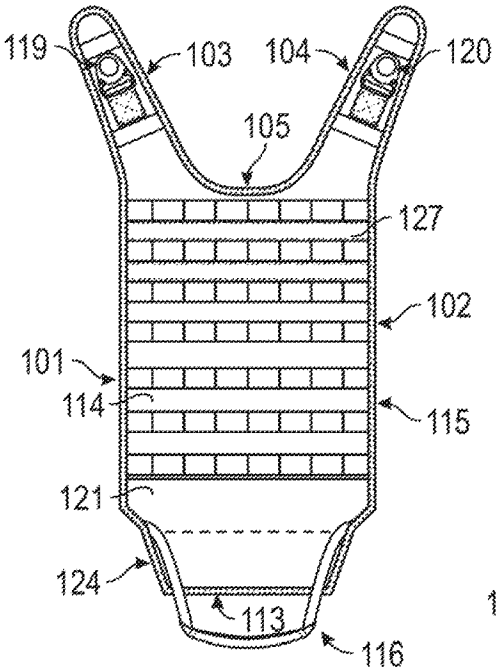
FIG. 18 is a front view of a front body armor carrier of the personal protection device of FIG. 1.
Figure 23:
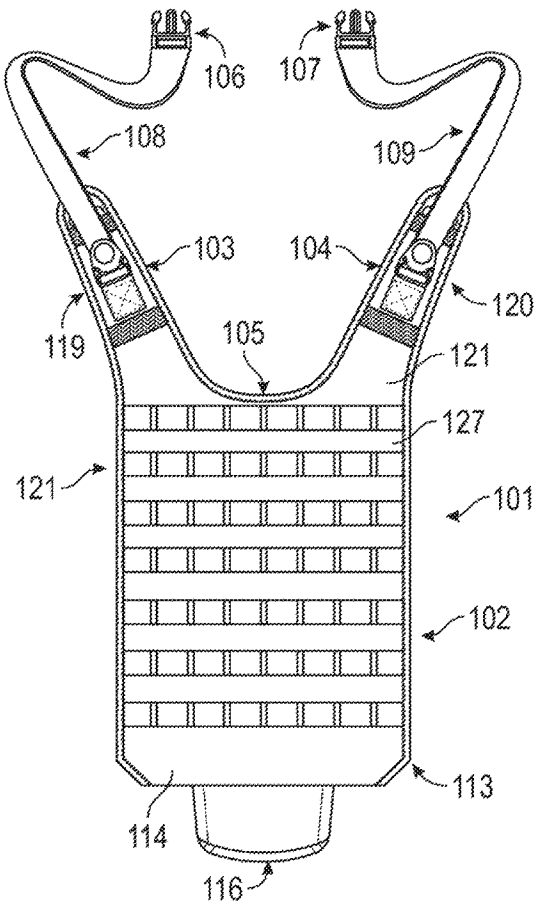
FIG. 23 is a front view of the front body armor carrier of FIG. 18 with the armor carrier straps of FIG. 10 attached.

An embodiment of the invention, as shown and described by the various figures and accompanying text, provides a personal protection device 100. As depicted in FIG. 10, the personal protection device 100 may include a front body armor carrier 101 and a pack 110. The pack 110 may be adapted to carry the front body armor carrier 101 in a non-deployed configuration, as depicted at least in FIGS. 1-5. A handle 116 may be secured to the front body armor carrier 101 and accessible to the wearer when in a non-deployed configuration. The wearer may easily grab the handle and pull the front body armor carrier 101 out of the pack 110 and position the front body armor carrier 101 over the wearer's torso in a deployed configuration as depicted at least in FIG. 10.

The front body armor carrier 101 may include a torso portion 102, first shoulder portion 103, second shoulder portion 104, and a handle 116. The torso portion may be adapted to cover substantially all of an average adult's chest area when the front body armor carrier 101 is place in a deployed configuration. The torso portion 102 may be rectangular with an upper portion 105 and an opposing lower portion 113. Although a rectangular shape is illustrated, those skilled in the art will appreciate that the torso portion 102 may have any shape while still accomplishing the goals, features, and objectives of the present invention. In the deployed configuration, the upper portion 105 may be located on, above, or near a wearer's chest while the lower portion 113 may be located below the wearer's chest. A first side 114 may extend from the upper portion 105 to the lower portion 113 and connect the two. A second side 115 may opposed the first side 114 and also extend from the upper portion 105 to the lower portion 113, connecting the two.

The front body armor carrier 101 may be formed by joining a front portion 121 and a back portion 122. The perimeter of the front portion 121 may be secured to the perimeter of the back portion 122 along the upper portion 105 and both the first and second side portions 114, 115 may form a front plate envelope between the two portions 121, 122 with an opening along the lower portion 113. The front plate envelope may be sized to removably carry a ballistic plate, which may be inserted and removed through the front plate envelope opening.

Figure 22:
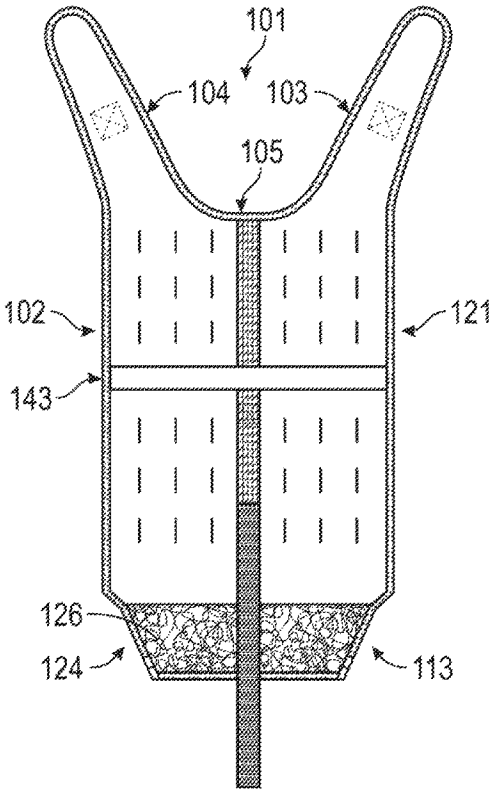
FIG. 22 is rear view of the front portion of the front body armor carrier of FIG. 18.

As depicted in FIG. 22, the front portion 121, may be reinforced with one or more strips of elastic 143. In the embodiment depicted in FIG. 22, the elastic 143 is preferably placed parallel to the width of the front body armor carrier 101. The ballistic plate may be placed between the back surface of the front portion 121 and the elastic 143, which may assist with keeping the ballistic plate in a plane parallel to both the front portion 121 and back portion 122.

A fabric strip 144, which may be, but is not limited to, nylon webbing, may be secured to an inner surface of front portion 121 and extend into the front body armor carrier envelope 133. In one embodiment, the fabric strip 144 may secure to an upper portion 105 of the front portion 121. The fabric strip 144 may extend down from the upper portion 105, wrap around the back side, bottom side, and front side of a ballistic plate when the ballistic plate is carried by the front body armor carrier envelope 133. The fabric strip 144 may have mating fasteners located at different positions on the same side of the fabric strip 144. The mating fasteners may be adapted to secure to one another to assist in retaining the ballistic plate in place securely in a plane parallel to the front portion 121 and to retain the ballistic plated above the lower portion 113 of the front body armor carrier 101. In one embodiment, the mating fasteners may be, but are not limited to, hook and loop fasteners. The fabric strip 144 may be secured directly to an inner surface of the front portion 121 at one or more portions of the fabric strip 144 which are located between the ballistic plate and the inner surface when the ballistic plate is received by the front body armor carrier envelope 133.

Figure 25:
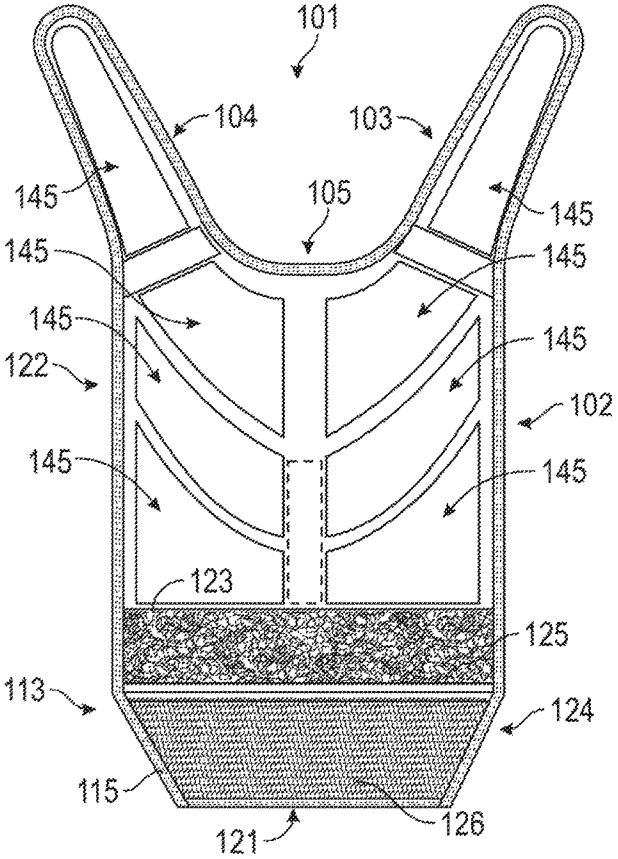
FIG. 25 is a rear elevation view of the front body armor carrier of FIG. 18 with the flap in an unsecured position.
Figure 24:
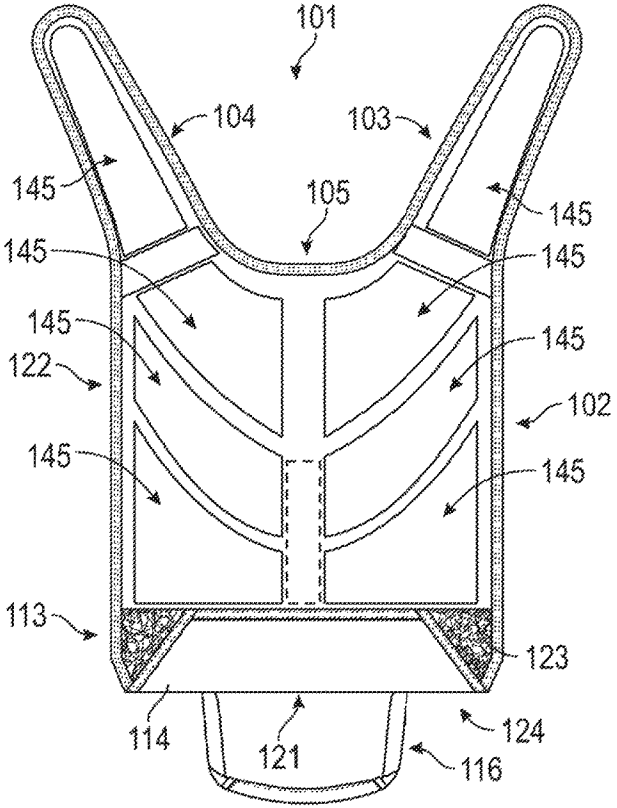
FIG. 24 is a rear elevation view of the front body armor carrier of FIG. 18 with the flap in a secured position.
Figure 27:
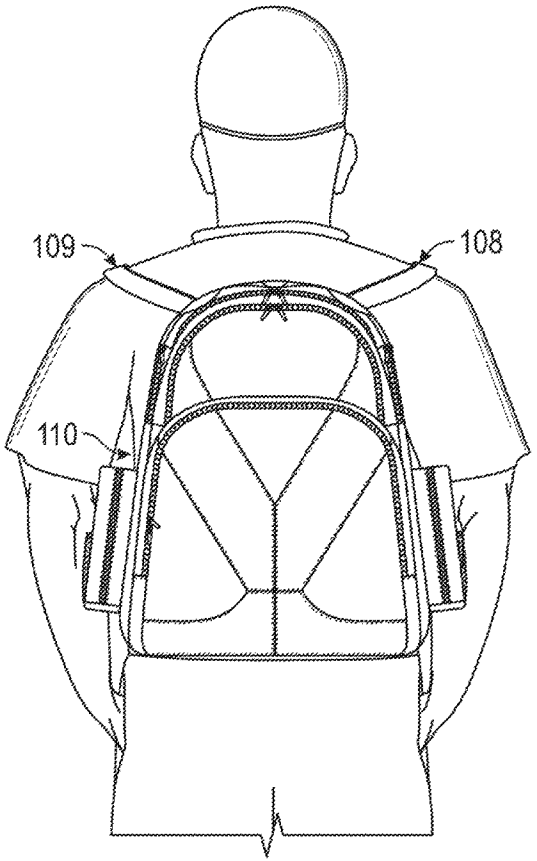
FIG. 27 is a rear environmental view of the personal protection device of FIG. 1 worn by a user.
Figure 26:
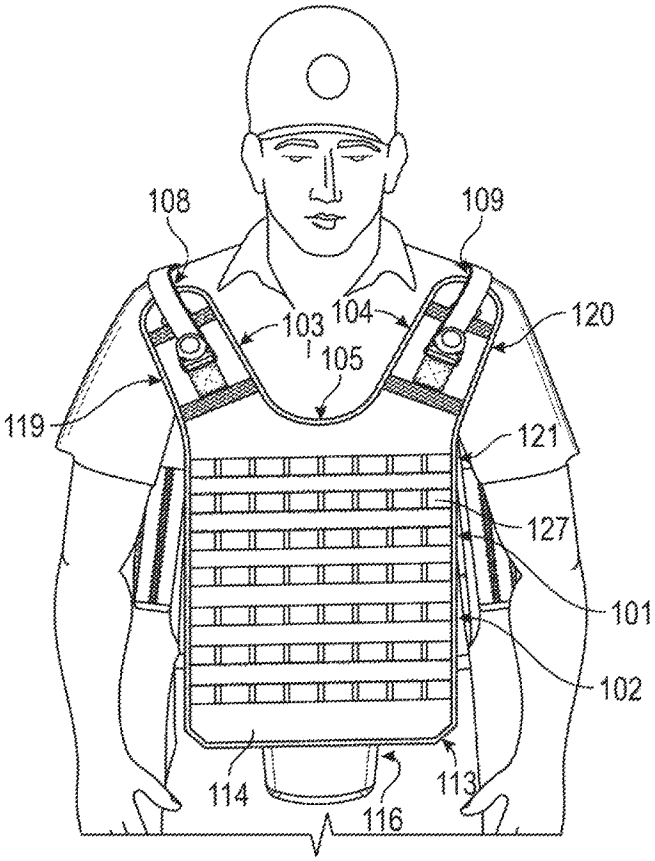
FIG. 26 is a front environmental view of the personal protection device of FIG. 1 worn by a user.

As shown in FIGS. 24 and 25, the back portion 122, which may lie closest to the user's chest when the pack is worn, may have integrated padding 145. The padding 145 may increase the comfort of the user.

A lower retention flap 124 may extend downwardly from the lower portion 113 of the front body armor carrier 101. The lower retention flap 124 may be fixedly secured to or integral with the lower portion 113 of the front portion 121 of the front body armor carrier 101. The lower retention flap 124 may be adapted to fold over the opening of the front plate envelope to retain a plate within the front plate envelope. A fastener 126, which may be, but is not limited to, a hook and loop, or the like fastener, may be located on a rear surface of the lower retention flap 124, which is the surface closest to the user when the front body armor carrier 101 is worn by the user. A mating fastener 125 may also be located on the rear surface of the front body armor carrier 101, on either the front portion 121, provided the front portion extends below the back portion, or back portion 122. When the second fastener 126 is folded up to mate with the first fastener 125, the front plate envelope may be closed and the plate may be securely retained therein.

Another fastener 127, which may be, but is not limited to, a hook and loop fastener, may be located on a front surface of the torso portion 102 of the front portion 121. A panel 128 may be adapted to secure to the fastener 127. The panel 128 may be, but is not limited to, a flexible fabric member having a fastener 130, which is adapted to secure to the fastener located on the torso portion 102, located on one side 129 and indicia 132 located on an opposing side 131. The indicia 132 may, for example, identify an agency or organization with which the wearer of the personal protection device 100 is associated.

A handle 116 may be secured to the lower portion 113. In one embodiment, the handle 116 may have two opposing ends. Each of the ends may secure directly to the lower portion 113, forming an opening between the lower portion 113 and the handle 116, providing a structure for a wearer to grasp and move the front body armor carrier 101 from a non-deployed to a deployed configuration. The handle 116 may be centered on the front body armor carrier 101. The position of the handle 116 may allow it to easily be grasped by a single hand, either the left or right, of the user. The handle 116 may be sized and configured to allow an adult hand to encircle the handle 116.

The pack 110 may include first and second pack fasteners 111, 112, which may removably secure to the front body armor carrier 101. The pack 110 may also include first and second shoulder straps 117, 118. Each shoulder strap 117, 118 may have a first and second end, both of which may be secured to the pack 110. The shoulder straps 117, 118 may be configured to allow a user to wear the pack on 110 on his or her back in the fashion of a traditional backpack.

First and second armor carrier straps 108, 109 may each have first and second ends. The first end of each of the armor carrier straps 108, 109 may be secured to a respective shoulder portion 103, 104. The first and second armor carrier straps 108, 109 may be of a sufficient length to allow the front body armor carrier 101 to be secured to the pack 110 using the straps 108, 109 while positioned over the front of a user's torso with the pack worn on the user's back. Each of the armor carrier straps 108, 109 may secure to a respective shoulder portion 103, 104 directly or by way of a fastener. In one embodiment, the fastener may be a rotational buckle 119, 120. In such an embodiment, the rotational buckle 119, 120 may be secured to the front body armor carrier 101 and a respective strap 108, 109. The rotational buckle 119, 120 may rotate with respect to the front body armor carrier 101. The connection to the armor carrier strap 108, 109 may allow the length of each armor carrier strap 108, 109 to be adjusted. Such an embodiment may allow the front body armor carrier 101 to be worn more comfortably by users of different sizes. The straps 108, 109 may each include adjusting members, which allows the length of each strap 108, 109 to be adjusted.

An armor carrier fastener 106, 107 may be secured to a second end of each of the armor carrier straps 108, 109. Each of the armor carrier fasteners 106, 107 may mate with respective pack fasteners 111, 112 carried by the pack 110. The armor carrier fasteners 106, 107 may provide a removable attachment between the pack fasteners 111, 112 of the front body armor carrier 101 and the pack 110. In one embodiment, the pack fasteners 111, 112 may be located with an envelope formed by the pack 110 and adapted to carry the front body armor carrier 101. The pack fasteners 111, 112 may be located at a bottom portion or a top portion of the pack 110 when worn by a user.

The pack 110 may have a front body armor carrier envelope 133 adapted to carry or store the front body armor carrier 101 in a non-deployed configuration. The pack 110 may also have a separate rear body armor envelope 134 adapted to carry a rear ballistic plate. The rear body armor envelope 134 and the front body armor carrier envelope 133 may lie in parallel planes. The plane of the rear body armor envelope 134 may be closer to the user's back than the plane of the front body armor carrier envelope 133 when the pack 110 is worn by the user. The front body armor carrier envelope 133 may be adjacent to and separated from the rear body armor envelope 134 by only a single divider within the pack 110. In one embodiment, the front body armor carrier envelope may be located between the rear body armor envelope 134 and a user's back when the pack 110 is worn by the user. In another embodiment, the rear body armor envelope 134 may be located between the front body armor carrier envelope and a user's back when the pack 110 is worn by the user.

Figure 6:
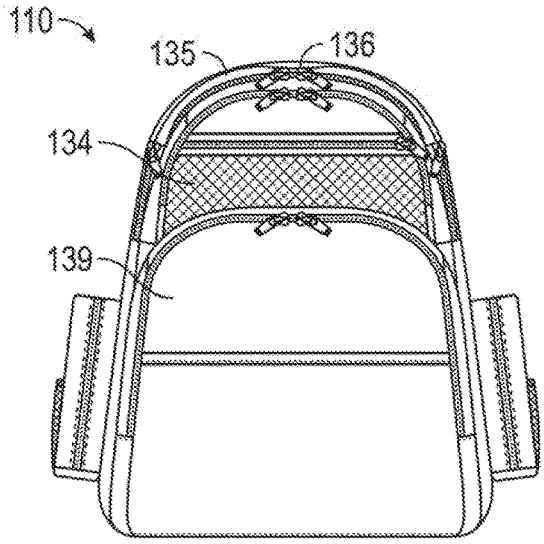
FIG. 6 is a front perspective view of the personal protection device of FIG. 1 with a portion of the outer surface removed to show an access to a rear body armor envelope.

One embodiment of the rear body armor envelope 134 may be depicted in FIG. 6. In this embodiment, the rear body armor envelope 134 is formed by mesh secured to an inner surface of the pack 110. The rear body armor envelope 134 may be accessed to place or remove a ballistic plate by using a zipper. The rear body armor envelope 134 may isolate a rear ballistic plate from other contents, which may be carried by the pack 110.

Figure 8:
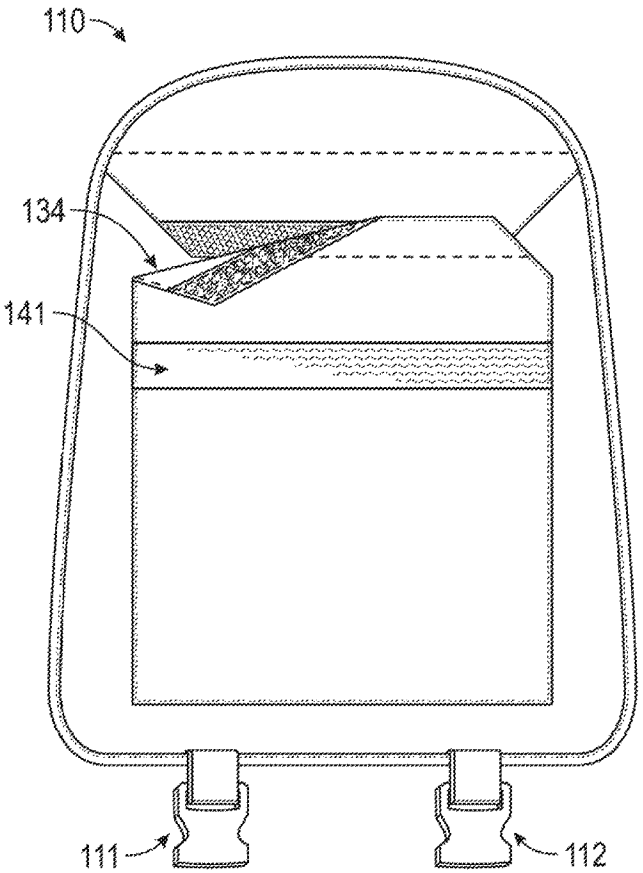
FIG. 8 is a front perspective view of an inner surface of the back side of the backpack of the personal protection device of FIG. 1.

Another embodiment of the rear body armor envelope 134 may be depicted in FIG. 8. This figure depicts an inner surface of the pack 110. The rear body armor envelope 134 may be formed by fixedly securing three sides of a rectangular fabric to an inner surface of the pack 110. A fourth side of the rectangular fabric may remain free and form an opening to the rear body armor envelope 134, through which a ballistic plate may be inserted and removed. Proximate the free side of the rectangular fabric, a fastener, including, but not limited to, hooks and loops, zippers, or the like, may be secured to the inner surface of the pack 110 and a mating fastener may be secured to the free side. These fasteners may mate to each other to secure the rear ballistic plate within the rear body armor envelope 134.

As depicted in FIG. 8, the material forming the rear body armor envelope 134, may be reinforced with one or more strips of elastic. In the embodiment depicted in FIG. 8, the elastic is placed parallel to the width of the rear body armor envelope 134. This may assist with keeping the ballistic plate secured to the inner surface of the pack 110 and also keep the material forming the rear body armor envelope 134 secured tightly against the inner surface when no ballistic plate is carried by the rear body armor envelope 134.

A fabric strip 142, which may be, but is not limited to, nylon webbing, may be secured to an inner surface of the pack 110 and extend into the rear body armor envelope 134, the fabric strip 142 may wrap around the back side, bottom side, and front side of a ballistic plate when the ballistic plate is carried by the rear body armor envelope 134. The fabric strip 142 may have mating fasteners located at different positions on the same side of the fabric strip 142. The mating fasteners may be adapted to secure to one another to assist in retaining the ballistic plate in place securely in a plane parallel to the plane of the inner surface of the pack 110 and above the bottom perimeter of the rear body armor envelope 134. In one embodiment, the mating fasteners may be, but are not limited to, hook and loop fasteners. The fabric strip 142 may be secured directly to the inner surface of the pack 110 at one or more portion of the fabric strip 142 which is located between the ballistic plate and the inner surface when the ballistic plate is received by the rear body armor envelope 134.

Figure 9:
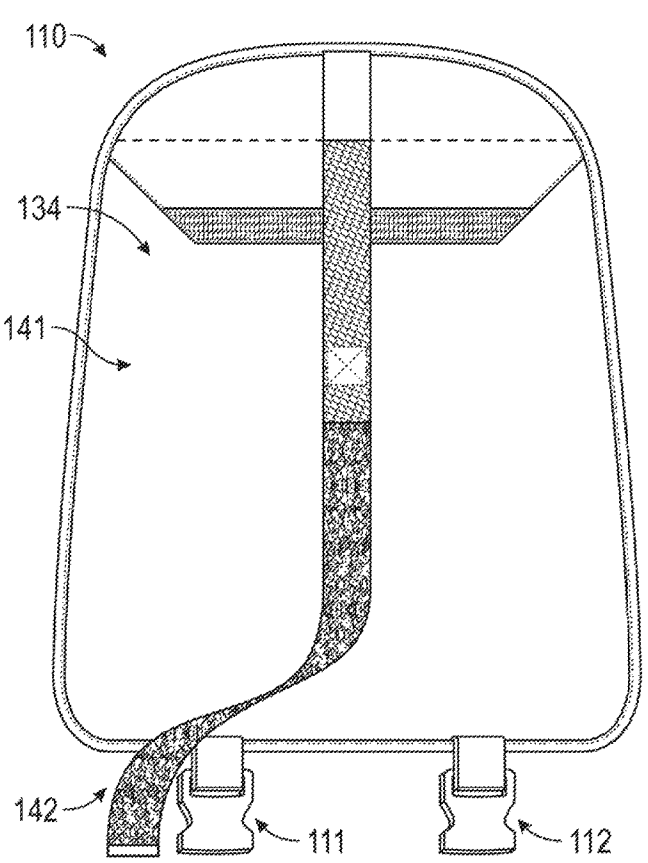
FIG. 9 is a front perspective view of the inner surface of the back side of the backpack of the personal protection device of FIG. 1.

As also depicted in FIGS. 8 and 9, the first and second pack fasteners 111, 112 may be located along a bottom portion of the pack 110 proximate a bottom portion of the rear body armor envelope 134.

When in the non-deployed configuration, the handle 116 may be located near a top portion of the pack 110. The handle 116 may be easily and quickly accessed by the user when the pack 110 is worn on the user's back. The handle 116 may be adapted to be grasped by a single hand of the user and pulled up and over the users head to position the front body armor carrier 101 in front of the user's torso, placing it in a deployed configuration. The top portion of the front body armor carrier envelope 133 may be covered, or partially covered, by two flaps 135, 136. A first flap 135 may be secured to an upper portion of the front side of the pack 110 and a second flap 136 may be secured to an upper portion of the back side of the pack 110. The two flaps 135, 136 may cooperatively cover an entirety of the upper portion or opening of the front body armor carrier envelope 133 or they may cover a substantial part of the opening of the front body armor carrier envelope 133 while not covering the handle 116 when stored in the non-deployed configuration. The handle 116 may be located near the flaps 135, 136 and easily accessible through the flaps 135, 136, when in a non-deployed configuration. The handle 116 may be accessible without the need to manually unfasten any component. That is, the opening of the front body armor carrier envelope 133 may be covered but accessible without manually or directly removing or disconnecting any fastener other than magnets.

Figure 2:
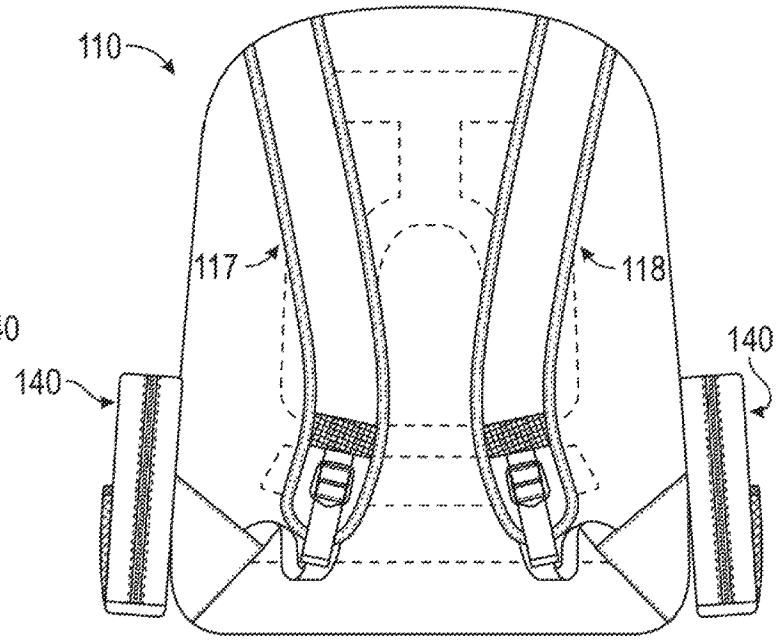
FIG. 2 is a rear perspective view of the personal protection device of FIG. 1.
Figure 1:
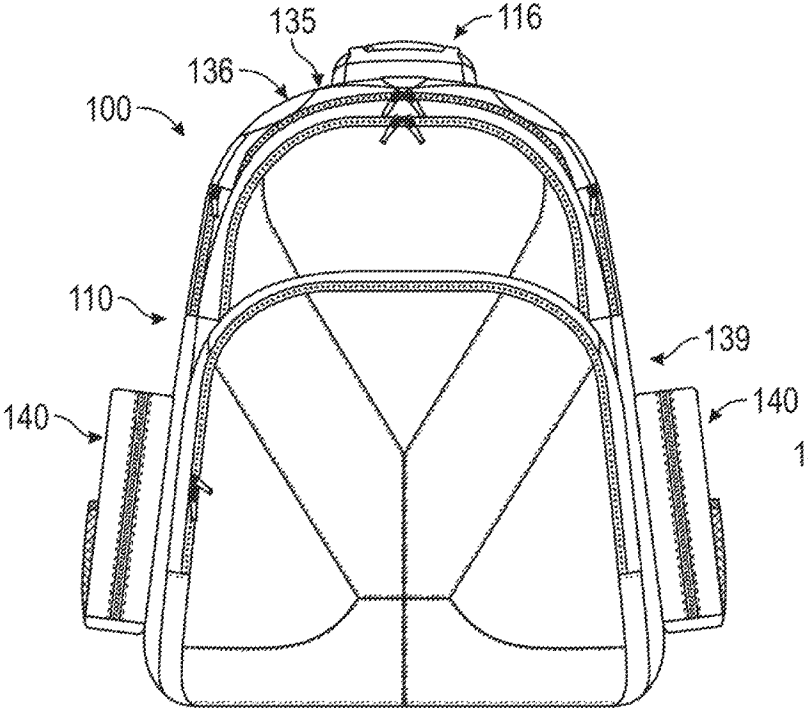
FIG. 1 is a front perspective view of a personal protection device in a non-deployed position according to an embodiment of the present invention.
Figure 4:
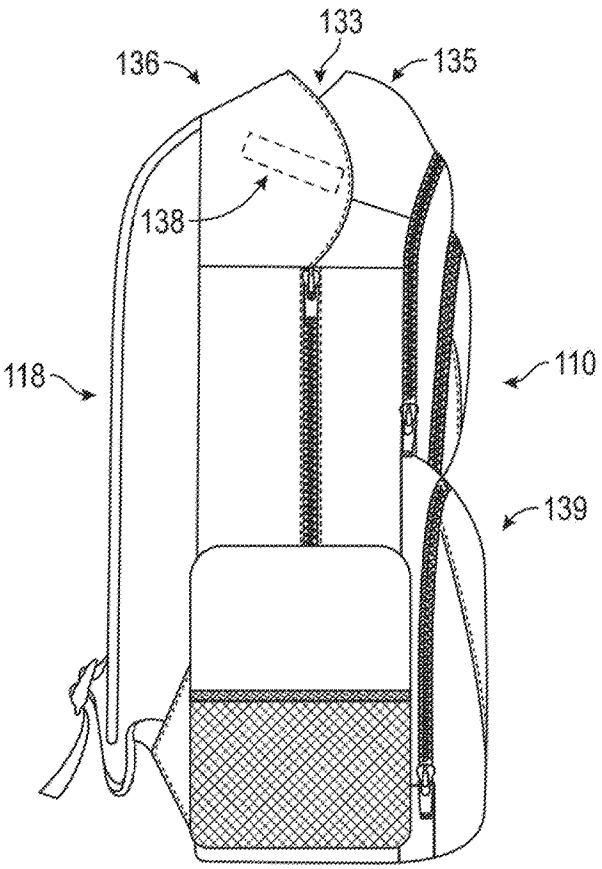
FIG. 4 is a second side view of the personal protection device of FIG. 1.
Figure 3:
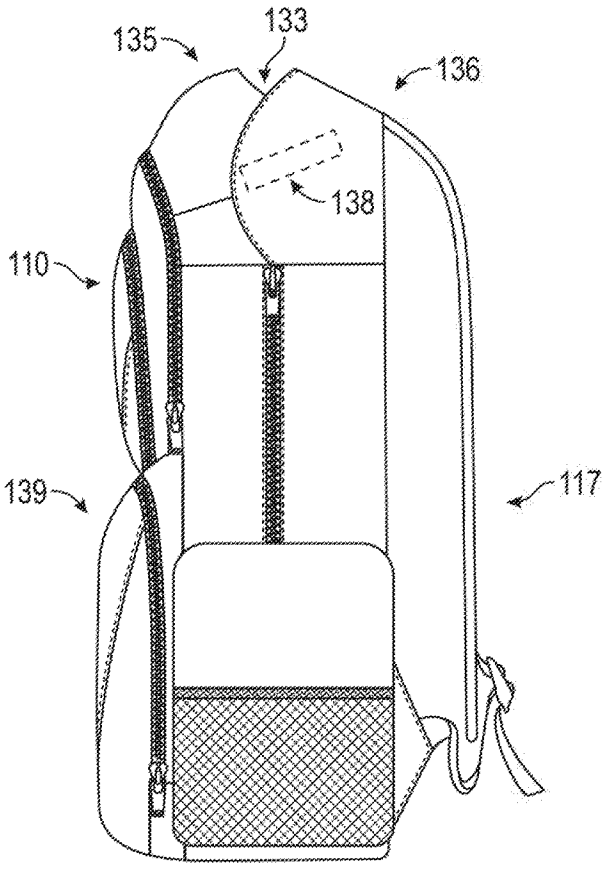
FIG. 3 is a first side view of the personal protection device of FIG. 1.
Figure 5:
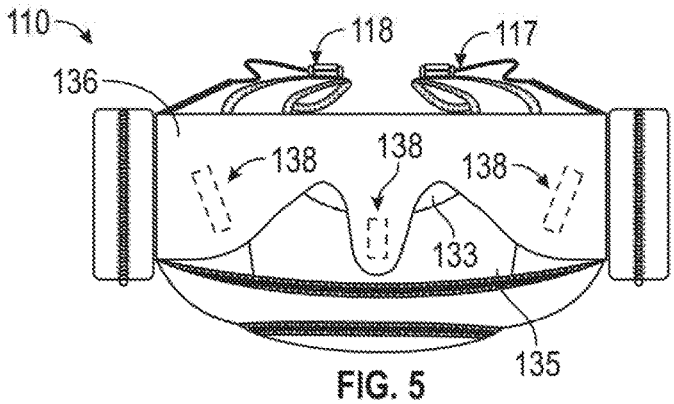
FIG. 5 is a top view of the personal protection device of FIG. 1.

In one embodiment a first magnet 137 may be carried by the first flap 135 and a second magnet 138 may be carried by the second flap 136. The magnets 137, 138 may be cooperatively configure to attract one another and keep the first and second flaps 135, 136 in a closed configuration. The magnets 137, 138 may be of a strength sufficient to keep the flaps 135, 136 secured to one another while not so strong as to prevent the flaps 135, 136 from separating when a user exerts force on the handle 116 to pull the front body armor carrier 101 through the opening covered by the flaps 135, 136. One or more magnets may be carried by each of the flaps 135, 136 and each magnet may have a corresponding mating magnet carried by the other flap 135, 136. One embodiment of the pack 110, which uses three sets of magnets 137, 138 is depicted in FIG. 5. In this embodiment, the handle 116 is covered by the second flap 136 and may be easily accessed by separating the magnet 138 in the second flap 136 from the magnet 137 in the first flap 135.

Each of the first magnet 137 and second magnet 138 may be formed from a plurality of discrete magnets. The discrete magnets may be secured directly to a single flexible material with the plurality of discrete magnets and the single flexible material forming the first magnet 137 or second magnet 138. In one embodiment, the first magnet 137 or second magnet 138 may be formed by securing a plurality of discrete magnets to a single flexible material in one or more rows. A plurality of discrete magnets may be secured in a plurality of rows to a single flexible material to form a first magnet 137 or second magnet 138. In one embodiment, each of the first magnet 137 and second magnet 138 may be formed by 12 discrete magnets secured to a single flexible material in two rows of six discrete magnets each. This configuration may allow the first magnet 137 and second magnet 138 to flex while still providing adequate magnetic pull to keep the flaps 135, 136 securely closed. In one embodiment, each of the discrete magnets used to form a first magnet 137 and a second magnet 138 may have a nominal 12.8 ounces of pull against a ferrous surface.

In one embodiment, the pack 110 may have one or more utility pouches 140. Each utility pouch 140 may provide one or more envelopes adapted to receive or carry one or more items. The utility pouches 140 may be removable from the pack 110 or fixedly secured to the pack 110. In one embodiment, the utility pouch 140 may be removably secured to an outer surface of the pack 110 using a fastener, which may include, but is not limited to, hooks and loops, zippers, or the like. One or more utility pouches 140 may be located on the sides of the pack 110. The utility pouch 140 may have an interior envelope, which may be accessed by opening a zipper located around or along the perimeter of the utility pouch 140. The utility pouch 140 may have a side pocket located on one or more faces of the utility pouch 140. The side pocket may be formed by securing three sides of a rectangular mesh to the utility pouch 140.

One or more utility pouches 140 may contain a first aid kit. In one embodiment, the first aid kit may include an individualized first aid kit, which may be a trauma kit containing essential life-saving material to control bleeding and treat major wounds. The individualized first aid kit may include, but is not limited to, a tourniquet, chest seal, combat gauze, other hemostatic agents, or the like.

The pack 110 may have one or more storage envelopes 139 adapted to hold personal belongings of the user including, but not limited to, books, papers, folders, laptops, personal electronic devices, gym clothes, or the like. The storage envelopes 139 may be separate envelopes from the front body armor carrier envelope 133 or the rear body armor envelope 134. These additional storage envelopes 139 may allow the pack 110 to serve as a traditional back pack while providing the extra benefit of removable ballistic protection, which may be easily deployed in the event of an emergency. One or more storage envelopes 139 may be adapted to carry a holster, spare magazine holder, radio, or the like without interfering with the ability of the personal protection device 100 to provide effective ballistic protection or the ease of deployment of the front body armor carrier 101.

Figure 7:
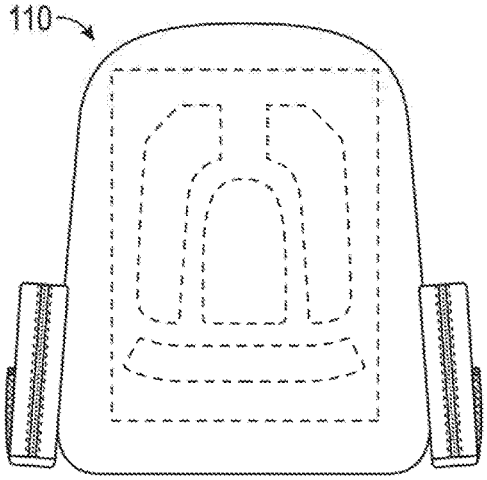
FIG. 7 is a rear perspective view of the personal protection device of FIG. 1, and showing locations and positions of rear pads.

The pack 110 may have the outward appearance of a traditional backpack and be adapted to carry the weight of two ballistic plates in addition to the weight of items that are ordinarily carried in backpacks, including, but not limited to, books, papers, folders, laptops, personal electronic devices, sports equipment, clothes, and the like. The pack 110 may have storage envelopes 139 adapted to hold water bottles, cell phones, or the like. Padding may be integrated into the back panel of the pack 110, which may lie closest to the user's back when the pack is worn. The padding may increase the comfort of the user and be sewn to the pack 110 as shown by dotted lines in FIG. 7.

Some of the illustrative aspects of the present invention may be advantageous in solving the problems herein described and other problems not discussed which are discoverable by a skilled artisan.

While the above description contains much specificity, these should not be construed as limitations on the scope of any embodiment, but as exemplifications of the presented embodiments thereof. Many other ramifications and variations are possible within the teachings of the various embodiments. While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention, but that the invention will include all embodiments falling within the scope of the appended claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

Thus the scope of the invention should be determined by the appended claims and their legal equivalents, and not by the examples given.

That which is claimed is:

1. A personal protection device comprising:

a front body armor carrier comprising:

a torso portion having an upper portion, an opposing lower portion, a first side extending from the upper portion to the lower portion, and a second side opposing the first side and extending from the upper portion to the lower portion, a first shoulder portion extending away from the upper portion proximate the first side, a second shoulder portion extending away from the upper portion proximate the second side, a handle having a first end secured to the lower portion and a second end secured to the lower portion, forming an opening between the handle and the lower portion, and a front plate envelope located between a front portion of the front body armor carrier and a back portion of the front body armor carrier;

a pack removably secured to the front body armor carrier and adapted to carry the front body armor carrier in a non-deployed configuration; and wherein the front plate envelope is adapted to removably carry a plate.

2. The personal protection device according to claim 1 further comprising:

a first armor carrier strap having a first end secured to the first shoulder portion;

a first armor carrier fastener secured to a second end of the first armor carrier strap;

a second armor carrier strap having a first end secured to the second shoulder portion; and a second armor carrier fastener secured to a second end of the second armor carrier strap.

3. The personal protection device according to claim 2 wherein the pack comprises:

a first pack fastener secured to the pack and adapted to mate with the first armor carrier fastener;

a second pack fastener secured to the pack and adapted to mate with the second armor carrier fastener;

a first shoulder strap having a first end secured to the pack and a second end secured to the pack; and a second shoulder strap having a first end secured to the pack and a second end secured to the pack.

4. The personal protection device according to claim 2 further comprising:

a first rotational buckle secured to the first end of the first armor carrier strap and the first shoulder portion; and a second rotational buckle secured to the first end of the second armor carrier strap and the second shoulder portion.

5. The personal protection device according to claim 3 wherein the pack further comprises:

a front body armor carrier envelope adapted to carry the front body armor carrier in a non-deployed configuration; and a rear body armor envelope adapted to carry a rear plate.

6. The personal protection device according to claim 5 wherein the rear body armor envelope lies in a first plane parallel to a second plane of the front body armor carrier envelope.

7. The personal protection device according to claim 5 wherein the pack further comprises:

a first flap secured to an upper portion of a front side of the pack; and a second flap secured to an upper portion of a back side of the pack and cooperatively configure with the first flap to extend across an entirety of a top side of the pack in a non-deployed configuration.

8. The personal protection device according to claim 7 wherein the pack further comprises:

a first magnet carried by the first flap;

a second magnet carried by the second flap and adapted to attract the first magnet to maintain the first flap and the second flap in a closed configuration.

9. The personal protection device according to claim 7 wherein the handle is positioned proximate the first and second flap in the non-deployed configuration.

10. The personal protection device according to claim 5 further comprising:

a utility pouch removably secured to a side of the pack.

11. The personal protection device according to claim 1 wherein the front body armor carrier further comprises:

a first fastener disposed on a rear surface of a front portion of the front body armor carrier; and a lower retention flap located at the lower portion of the front portion of the front body armor carrier proximate an opening of the front plate envelope, having a second fastener disposed thereon and adapted to be positioned across the opening and securable to the first fastener.

12. The personal protection device according to claim 1 wherein the front body armor carrier further comprises:

a first fastener secured to a front surface of the front portion of the front body armor carrier.

13. The personal protection device according to claim 12 further comprising:

a panel having a first side with a panel fastener disposed thereon and an opposing second side with indicia disposed thereon, wherein the panel fastener is adapted to mate with the first fastener secured to the front surface of the front portion of the front body armor carrier.

14. A personal protection device comprising:

a front body armor carrier comprising:

a torso portion having an upper portion, an opposing lower portion, a first side extending from the upper portion to the lower portion, and a second side opposing the first side and extending from the upper portion to the lower portion, a first shoulder portion extending away from the upper portion proximate the first side, a first armor carrier fastener secured to the first shoulder portion, a second shoulder portion extending away from the upper portion proximate the second side, a second armor carrier fastener secured to the second shoulder portion, and a handle having a first end secured to the lower portion and a second end secured to the lower portion, forming an opening between the handle and the lower portion; and a pack removably secured to the front body armor carrier and adapted to carry the front body armor carrier in a non-deployed configuration, comprising a first pack fastener secured to the pack and adapted to mate with the first armor carrier fastener, a second pack fastener secured to the pack and adapted to mate with the second armor carrier fastener, a first shoulder strap having a first end secured to the pack and a second end secured to the pack, a second shoulder strap having a first end secured to the pack and a second end secured to the pack, and a front body armor carrier envelope adapted to carry the front body armor carrier in a non-deployed configuration.

15. The personal protection device according to claim 14 wherein the pack further comprises:

a first flap secured to an upper portion of a front side of the pack;

a second flap secured to an upper portion of a back side of the pack and cooperatively configure with the first flap to extend across an entirety of a top side of the pack in a non-deployed configuration;

a first magnet carried by the first flap; and a second magnet carried by the second flap and adapted to attract the first magnet to maintain the first flap and the second flap in a closed configuration.

16. The personal protection device according to claim 15 wherein the handle is positioned proximate the first and second flap in the non-deployed configuration.

17. The personal protection device according to claim 14 wherein the front body armor carrier further comprises:

a first fastener disposed on a rear surface of a front portion of the front body armor carrier and a lower retention flap located at the lower portion of the front portion of the front body armor carrier proximate an opening of the front plate envelope, having a second fastener disposed thereon and adapted to be positioned across the opening and securable to the first fastener.

18. The personal protection device according to claim 14 wherein the pack further comprises:

a rear body armor envelope adapted to carry a rear plate wherein the rear body armor envelope lies in a first plane parallel to a second plane of the front body armor carrier envelope.

19. A personal protection device comprising:

a front body armor carrier comprising:

a torso portion having an upper portion, an opposing lower portion, a first side extending from the upper portion to the lower portion, and a second side opposing the first side and extending from the upper portion to the lower portion, a first shoulder portion extending away from the upper portion of the torso portion proximate the first side, a second shoulder portion extending away from the upper portion of the torso portion proximate the second side, a handle having a first end secured to the lower portion and a second end secured to the lower portion, forming an opening between the handle and the lower portion, a first fastener disposed on a rear surface of a front portion of the front body armor carrier, a front plate envelope located between the front portion of the front body armor carrier and a back portion of the front body armor carrier, a lower retention flap located at the lower portion of the front portion of the front body armor carrier proximate an opening of the front plate envelope, having a second fastener disposed thereon and adapted to be positioned across the opening and securable to the first fastener, and a second fastener secured to a front surface of the front portion of the front body armor carrier;

a pack removably secured to the front body armor carrier and adapted to carry the front body armor carrier in a non-deployed configuration comprising:

a first pack fastener secured to the pack and adapted to mate with a first armor carrier fastener, a second pack fastener secured to the pack and adapted to mate with a second armor carrier fastener, a first shoulder strap having a first end secured to the pack and a second end secured to the pack, a second shoulder strap having a first end secured to the pack and a second end secured to the pack, a front body armor carrier envelope adapted to carry the front body armor carrier in a non-deployed configuration, a rear body armor envelope adapted to carry a rear plate, a first flap secured to an upper portion of a front side of the pack, a second flap secured to an upper portion of a back side of the pack and cooperatively configure with the first flap to extend across an entirety of a top side in a non-deployed configuration, a first magnet carried by the first flap, and a second magnet carried by the second flap and adapted to attract the first magnet to maintain the first flap and the second flap in a closed configuration;

a first armor carrier strap having a first end secured to the first shoulder portion;

the first armor carrier fastener secured to a second end of the first armor carrier strap;

a second armor carrier strap having a first end secured to the second shoulder portion;

the second armor carrier fastener secured to a second end of the second armor carrier strap;

a first rotational buckle secured to the first end of the first armor carrier strap and the first shoulder portion;

a second rotational buckle secured to the first end of the second armor carrier strap and the second shoulder portion;

a panel having a first side with a panel fastener disposed thereon and an opposing second side with indicia disposed thereon, wherein the panel fastener is adapted to mate with the second fastener; and a utility pouch removably secured to a side of the pack;

wherein the front plate envelope is adapted to removably carry a plate;

wherein the rear body armor envelope lies in a first plane parallel to a second plane of the front body armor carrier envelope; and wherein the handle is positioned proximate the first and second flap in the non-deployed configuration.

* * * * *